US005411152A

United States Patent [19]

Matthews et al.

[11] Patent Number: 5,411,152

[45] Date of Patent: May 2, 1995

[54] APPARATUS FOR SORTING OBJECTS ACCORDING TO SIZE

[75] Inventors: Mark Matthews, Richardson; Michael R. Weidman, Plano, both of Tex.

[73] Assignee: Texas Instruments Incorporated, Dallas, Tex.

[21] Appl. No.: 159,645

[22] Filed: Nov. 30, 1993

[51] Int. Cl.[6] ..... B07B 13/05

[52] U.S. Cl. ..... 209/668; 209/670

[58] Field of Search ..... 209/670, 673, 667, 668

[56] References Cited

U.S. PATENT DOCUMENTS 2,614,691 10/1952 Slayter ..... 209/668

2,960,224 11/1960 Cronan ..... 209/668

*Primary Examiner*—Kenneth W. Noland

*Attorney, Agent, or Firm*—John D. Kaufmann; James C. Kesterson; Richard L. Donaldson

[57] ABSTRACT

A roll sorter (110) includes two counter-rotating, circular cross-section, spaced rollers (112,114) defining a gap (124) therebetween. Particles 46 float on the rollers (112,114) within a sorting region (128) and are sorted by passing through the gap (124) or not so passing and being retained in the sorting region (128). The particles (46) are prevented from hopping or jumping out of the sorting region (128) by a circular cross-section rod 160 floating above the sorting region (128) on the rollers (112,114), so that sorting accuracy and throughput are not degraded.

16 Claims, 2 Drawing Sheets

APPARATUS FOR SORTING OBJECTS ACCORDING TO SIZE

BACKGROUND OF THE INVENTION

The present invention relates to apparatus for sorting objects by size, and, more particularly, to roll sorters for sorting by size easily damageable, generally particulate objects, such as silicon spheres or silicon spheroids which are intended for inclusion in solar cells.

Roll sorters are known. A typical roll sorter comprises a pair of generally horizontally oriented, spaced, generally coextensive, counter-rotatable rollers. The rollers have generally circular cross-sections and are coextensively positioned side-by-side with their axes either substantially parallel or diverging. Where the spaced horizontal rollers are parallel and do not diverge, a more or less uniform gap is defined between the closest approach of their facing surfaces. A widening gap is defined between the facing surfaces of rollers having diverging axes. The uniform or diverging gap between the rollers is generally horizontal, that is, substantially level or slightly tilted from the horizontal. The gap may be viewed as being coplanar with an imaginary plane which is defined between and "interconnects" the horizontal major axes of the rollers.

A feeding region, zone or volume is defined above the imaginary plane. The feeding region is bounded by such plane and by the facing surfaces of the horizontal rollers above the plane. The rollers are counter-rotated so that their facing surfaces (a) move through and then upwardly out of the sorting region above the imaginary plane and (b) move toward and then into the sorting region below the imaginary plane.

The rollers are counter-rotated and a quantity of particles having varying sizes is deposited within or fed into the sorting region. The particles may be spheres, such as ball bearings, or spheroids with smooth or uneven surfaces. Because the rollers are counter-rotated in the manner described, they effectively "float" on the roller surfaces and damage thereto is avoided. In effect, floating results in the particles not being drawn into the gap and not being crushed between the rollers, as would be the case if the rollers were oppositely counter-rotated, the particles instead riding on the roller surfaces within the sorting region. The floating particles are maintained in a constant state of agitation by the rotating rollers so that particles in the sorting region which are capable of passing through the gap are periodically presented to and pass through the gap where they fall downwardly into or onto a collector, such as a container or a conveyor.

Over time, the foregoing operation of a roll sorter will sort the particles into two size groups. Particles in the first group are incapable of passing through the gap; these particles may, until removed from the sorting region, remain floating and in a state of agitation on the counter-rotating rollers. Particles in the second group are those which fall through the gap.

Where the gap between the rollers diverges, particles are similarly sorted into two size groups. The first group includes particles unable to fall through even the widest portion of the diverging gap. The second group is comprised of a number of subgroups. Specifically, one subgroup includes particles capable of passing through the narrowest portion of the diverging gap, while a second subgroup includes particles capable of passing through a wider portion of the gap. The number of such subgroups is theoretically infinite, but, in practice is limited to a finite number of subgroups. For example, a first subgroup may include particles capable of passing through a first portion of the diverging gap, such first portion extending a first distance from the narrowest portion of the gap along the rollers to a somewhat wider portion. A collector placed under the rollers and extending therealong for the first distance will collect particles having sizes within a range set by and equal to or smaller than the diverging width of the associated portion of the gap. Subsequent subgroups will include particles having progressively larger ranges of sizes.

If the particles are placed into the sorting region at or near one end or the other of the roller pair, the floating action effected by the counter-rotating rollers tends to distribute the particles along the sorting region. If parallel, non-diverging rollers are used, the particles may be placed into the sorting region at either end of the roller pair. If diverging rollers are used, the particles should be placed in the sorting region at or near the ends of the rollers whereat the gap is the narrowest to take full advantage of the particle distribution along the sorting region caused by the floating action which aids in segregating the particles into the subgroups.

The prior art also contemplates tilting the rollers out of their horizontal orientation so that one end thereof is higher than the other end. Tilting of the rollers effects the gravity-assisted movement of those floating particles which are too large to pass through the gap away from the higher roller ends and toward the lower roller ends. In this fashion, tilting also aids the particle-distributive effect of the floating action. Ultimately, particles which are too large to pass through the gap—either uniform or diverging—are moved to the lower roller pair ends. These too large particles may be permitted or made to leave the lower portion of the sorting region and the associated roller surfaces and fall into or onto a collector, such as a container or a conveyor.

It is known that increasing the tilt angle of the roller pairs and/or increasing the rotational speed of the rollers increases the throughput of the sorter. The price for such increased throughput is decreased accuracy in sorting. Such decreased accuracy results from the floating action and the tilted-roller, gravity-assisted movement described above. Specifically, increasing the tilt angle effects more rapid movement of the particles from the higher to the lower roller ends. The more rapid movement, in theory, results in more rapid sorting and higher throughput. However, due to the floating action and the more rapid movement, frictional effects between the rollers and the particles may cause a particle to "float," "hop" or "jump" over and bypass a portion of the gap through which it is capable of passing and thereafter pass through a subsequent portion of the gap which is wider than necessary to permit such passage. An increase in roller rotation speed leads to a similar result by so accentuating the floating action that passage of particles through the gap is inhibited or prevented.

The above-described type of roller sorter is viewed favorably and deemed suitable for the sorting of spherical or nearly spherical silicon particles, particularly those ultimately used in fabricating solar cells. A solar cell, or photovoltaic device, converts incident radiant energy, such as sun light, into electricity.

The following commonly assigned U.S. Patents generally describe spherical or spheroidal silicon particles of the type which may be conveniently sorted by size by a roll sorter, the need to effect sorting of these silicon particles by size, and the type of solar cells in which such size-sorted silicon particles may be included: U.S. Pat. Nos. 5,223,452; 5,208,001; 5,091,319; 5,069,740; and 4,691,076.

Silicon spheres and spheroids used in constructing solar cells—and various other spheres or spheroids which are put to different uses—are small and somewhat fragile and may be damaged due to rough handling. Moreover, solar cells of the kind shown in the above-identified patents preferably include arrays of large numbers of same-sized or close-in-size silicon spheres mounted to flexible metal foils. Typical silicon sphere production techniques produce batches of intermingled silicon spheres or spheroids having varying sizes or diameters, typically 25–45 mils. Thus, manufacturing the above type of solar cell requires accurate, non-damaging sorting of large numbers of small, fragile silicon spheres. Such sorting should be efficient and have high throughput so as not to constitute a bottleneck in a solar cell manufacturing operation.

The silicon particles which are used in the foregoing type of solar cells are typically not perfectly spherical, and the effects of friction between the rollers and the particles cannot be totally ignored. If the above-described type of roll sorter is used to sort these small silicon particles, surface characteristics of the particles and the rollers, such as irregularities on the particles which are floating and agitated on the counter-rotating surfaces of the rollers, can cause the particles to "hop" or "jump" upwardly. Some of the "hopping" particles may exit the sorting region. More importantly, however, "hopping" particles may not pass through the gap at the first opportunity to do so, instead "jumping" over the appropriate gap portion and passing through a wider-than- necessary portion of the gap. Thus, "hopping" and "jumping" have a primary effect of decreasing the accuracy of the sorting effected on particles by a roll sorter. A secondary effect is a decrease in throughput where "hopping" leads to particles exiting the sorting region.

The foregoing effect of "hopping" on accuracy is accentuated if the rotational speed and/or the tilting of the rollers is increased in an attempt to increase the throughput of the sorter: Increases in rotational speed increase floating and, as a result, increase the frequency and magnitude of "hopping." Increases in tilting, increase the distance a "hopping" particle may travel.

The deleterious effects of "hopping" on accuracy are magnified where a roll sorter is used to sort very small particles having a rather narrow range of size variations. The sizes of the small (25–45 mil) silicon particles described above vary by about 20 mils. Accordingly, in a roll sorter of the type having tilted, diverging rollers, the rollers and the gap defined therebetween will diverge only about 20 mils and size differences between adjacent subgroups are quite small. As the length of the gap and sorting region defining each subgroup decreases, the deleterious effects of "hopping" increase.

An object of the present invention is the provision of an efficient, high throughput, non-damaging apparatus for sorting by size small, fragile particles, such as silicon spheres or spheroids, which apparatus prevents jumping, hopping or other improper movement of the particles within the sorting region.

SUMMARY OF THE INVENTION

With the above and other objects in view, the present invention contemplates improved apparatus for sorting particulate material by size. The particles may be commingled silicon spheres or spheroids having varying sizes which are intended for use in the manufacture of solar cells.

The apparatus is generally of the type described above and includes a pair of adjacent, generally coextensive circular rollers, the facing surfaces of which are separated by a gap which is coplanar with a plane defined by the rollers' major axes. The rollers are generally horizontal, that is, they are level or are slightly tilted. A sorting region is defined and bounded by the plane and by the rollers' facing surfaces above the plane. The rollers are counter-rotated so that their facing surfaces above the plane rotate away from the sorting region and below the plane rotate into the sorting region. Particles within the sorting region float on the counter-rotating rollers.

The improved apparatus includes a facility for preventing the floating particles from hopping or jumping within or out of the sorting region and thereafter moving along the gap and reentering the sorting region. Such hopping and jumping is caused by the frictional effects of the rollers on the floating particles. In sorters having both uniform and diverging gaps, hopping and jumping of particles can prevent their being sorted at all. In sorters having diverging gaps—where the floating particles are intended to pass through the gap at the narrowest possible width—hopping or jumping can cause the particles to pass through the a wider than necessary portion of the gap, thus adversely affecting the accuracy of the sorter.

In preferred embodiments, the preventing facility is a circular rod which is located in the sorting region so that it tangentially engages and floats on the rollers. The distance between the lower surface of the rod and the plane is such that hopping and jumping of the particle is obviated without adversely affecting the sorting throughput of the sorter. Such an adverse effect could follow from, for example, a too small distance between the plane and the rod which minimized the size or volume of the sorting region. A sorting region of minimal size limits the number of particles which may enter therein. This, in turn, can decrease the throughput of the sorter.

The preventing facility may be used with sorters having uniform and diverging gaps and in which the rollers are level or tilted. The rod is preferably a right circular cylinder, though a tapered rod may be used. The rod may be coextensive with the sorting region or may be associated with only a portion thereof.

BRIEF DESCRIPTION OF THE DRAWING

All of the Figures hereof are somewhat diagrammatic or schematic, stylized representations of generalized embodiments of both the prior art and the present invention, wherein.

DETAILED DESCRIPTION

Figure 3:
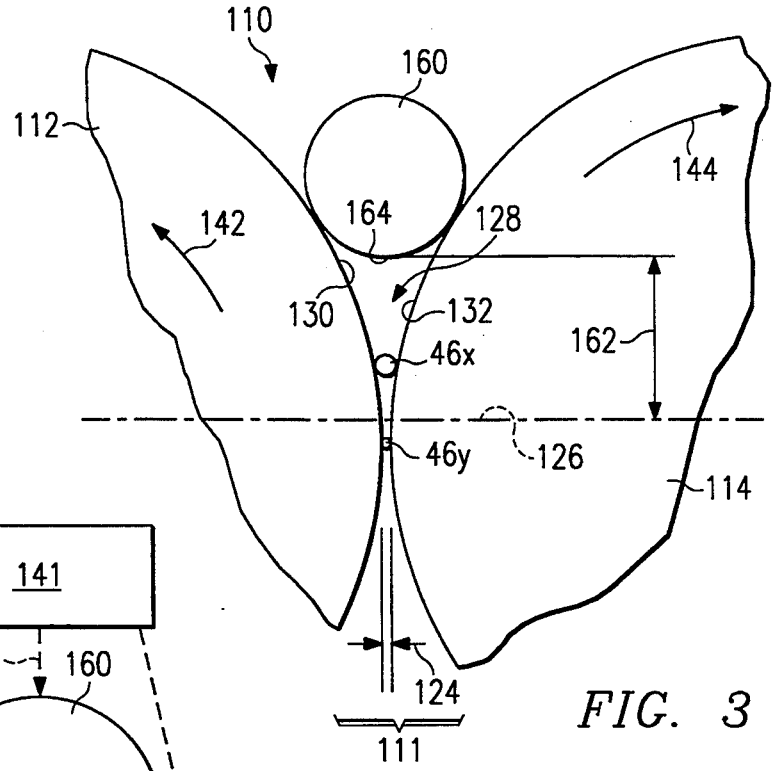
FIG. 3 is a magnified view of a portion of FIG. 2 wherein the relative sizes of some of the elements thereof and particles to be sorted are more accurately shown.

Referring first to FIG. 1, there is shown a general depiction of a roll sorter 10 according to the prior art. The elements of the improved roll sorters depicted in FIGS. 2 and 3 are numbered similarly to the elements of the prior art sorter 10. The relative sizes of the elements of all Figures are not to scale in order to better illustrate the principles of the present invention.

As seen in FIGS. 1(*a*)–1(*c*), a typical prior art roll sorter includes a pair 11 of rollers 12 and 14. The rollers 12,14 are preferably right circular cylinders with major axes 16 and 18 and generally circular cross-sections, with centers 20 and 22 through which the axes 16,18 pass. In the prior art sorter 10 of FIGS. 1(*a*)–1(*c*) the rollers 12,14 are positioned side-by-side and are generally coextensive. In one prior art embodiment, the rollers 12,14 are parallel. As a consequence, the rollers 12,14 are spaced to define a uniform gap 24 therebetween. The uniform gap 24 is coplanar with a plane 26 which is defined and bounded by—and may be viewed as "interconnecting" or containing—the major axes 16,18. A sorting region 28 is defined and bounded by the plane 26 and by the facing surfaces 30 and 32 of the rollers 12,14, with the sorting region 28 lying above the plane 26.

As implied by FIG l(*a*), both rollers 12,14 of the roller pair 11 may be substantially level. In this event, the major axes 16,18 of the rollers 12,14 and the uniform gap 24, the plane 26 and the sorting region 28 are also level. Preferably, for reasons explained below, the rollers 12,14 may be tilted out of a level orientation so that adjacent ends 34 and 36 of the rollers 12,14 are higher than their respective opposite ends 38 and 40, as shown in FIG. 1(*b*). In this latter event, the major axes 16,18, the uniform gap 24, the plane 26 and the sorting region 28 are also tilted. Both substantially level and tilted rollers 12,14 are referred to herein as "generally horizontal."

As shown in FIG. 1(*d*), the rollers 12,14 may diverge so that the adjacent ends 34,36 are more proximate or closer together than are the opposite ends 38,40. In this event, the gap 24 between the rollers 12,14 is not uniform and widens or diverges as it extends from the proximate ends 34,36 to the ends 38,40. This divergence is highly exaggerated in FIG. 1 (d). in the case of the diverging rollers 12,14, the major axes 16,18 and the sorting region 28 also diverge, and the major axes 16,18, the diverging gap 24, the plane 26 and the sorting region 28 are substantially horizontal, that is, they may be either level or tilted.

Appropriate mounting facilities of any suitable type may be used to mount the rollers 12,14 and to selectively adjust the width of the gap 24, as described above. The rollers 12,14 are counter-rotated by appropriate, selectively energizable facilities which include a source of motive power and interconnections therefrom to the rollers 12,14. The roller-mounting, gap-adjusting and counter-rotating facilities for the rollers 12,14 are schematically depicted at 41 in FIG. 1(*a*).

Counter-rotation of the rollers 12,14 is indicated by the arrows 42 and 44 in FIG. 1(*a*) and comprises (*a*) movement of the surfaces 30,32 of the rollers 12,14 out of and away from the sorting region 28 above the plane 26 and (*b*) movement of the surfaces 30,32 toward and into the sorting region 28 below the plane 26. As illustrated in FIG. 1(*a*) and in similar Figures, appropriate counter-rotation comprises counterclockwise rotation of the left-hand roller 12 and clockwise rotation of the right-hand roller 14.

As shown in FIG. 1(*b*), particulate material 46 is fed by or from a supply 48 into the sorting region 28 of the roller pair 11. Movement of the particles 46 from the supply 48 may be effected by any convenient feed assistant, a conveyor, moving gas, or another similar expedient, all as schematically indicated at 49 in FIG. 1(*b*). As explained below, if the rollers 12,14 are tilted as in FIG. 1(*b*), the particulate material 46 preferably enters the sorting region 28 at an input zone 50 thereof which is located at or near the higher ends 34,36. If the rollers 12,14 diverge, as in FIG. 1(*d*), the input zone 50 is located at or near the proximate ends 34,36. If the rollers 12,14 are both tilted and diverge, the input zone 50 is located at or near the higher, proximate ends 34,36. If the rollers 12,14 do not diverge, the input zone 50 may be located elsewhere in the sorting region 28 relative to the proximate ends 36,38 or may extend or be distributed along some or all of the sorting region 28. In this latter event, the supply 48 and the feed assistant 49 will be configured as necessary.

The sizes of the particles 46 relative to each other and to the sizes of the rollers 12, 14 and the gaps 24 as depicted in FIG. 1 are not to scale and have been depicted as such only in order to illustrate the present invention.

The particulate material 46 may include commingled particles 46*a*, 46*b* . . . 46*e* . . . etc. of varying sizes or diameters where the particles 46 are generally spherical or spheroidal, 46*a* being the smallest. Referring to FIG. 1(*a*), it assumed that the sorter 10 segregates smaller particles 46*a*, 46*b* and 46*c* from larger particles 46*d*, 46*e* . . . etc. The gap 24 therefore has a width which permits the particles 46*a*, 46*b* and 46*c* to pass therethrough, but which prevents the particles 46*d*, 46*e*. etc., from so passing. Assuming the rollers 12 and 14 are horizontal, the particles 46 are fed from the supply 48 by the feed assistant 49 into the input zone 50 which may be near the roller ends 34,36 or may be distributed along the rollers 12 and 14 generally coincident with the sorting region 28. As the rollers 12 and 14 counter-rotate, the particles float on the roller surfaces 30, 32 within the sorting region 28. Due to the floating action, the particles 46*a*, 46*b* and 46*c* ultimately reach and pass through the gap 24 where they fall into a collector 52, which may be a bin, conveyor, or the like. The collector 52 extends normally to the plane of FIG. 1(*a*) and may be generally coextensive with the rollers 12 and 14. To ensure that the collector 52 captures the particles 46*a*, 46*b* and 46*c* it may be positioned closely to the rollers 12 and 14 beneath the gap 24 and the sorting region 28, or guides 54 such as a chute, funnel-like plenum, or angled plates may direct the particles 46*a*, 46*b* and 46*c* into the collector 52.

As the smaller particles 46*a*, 46*b* and 46*c* pass through the gap 24, the larger particles 46*d*, 46*e*, etc. continue to float on the roller surfaces 30, 32 within the sorting region 28. These larger particles 46*d*, etc. may be periodically removed, as necessary to permit the sorter 10 to continue operating efficiently. In the foregoing manner, the particles 46 are sorted into two groups, those having sizes equal to or less than the size of the particles 46c—assuming that the diameter of the particles 46c is roughly equal to the width of the gap 24—and those having sizes equal to or larger than the size of the particles 46d.

Figure 1A:
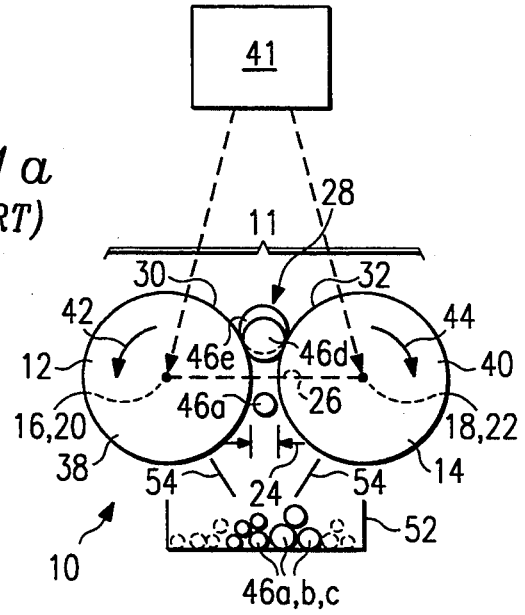
FIG. 1a (PRIOR ART)
FIG. 1 depicts a prior art roll sorter of the type improved by the present invention, in which FIG. 1(*a*) is a side view, FIG. 1(*b*) is a front view taken from the left of FIG. 1(*a*), and FIG. 1(*c*) is a plan view of one type of prior art roll sorter, and FIG. 1(*d*) is a plan view of another type of prior art roll sorter.
Figure 1B:
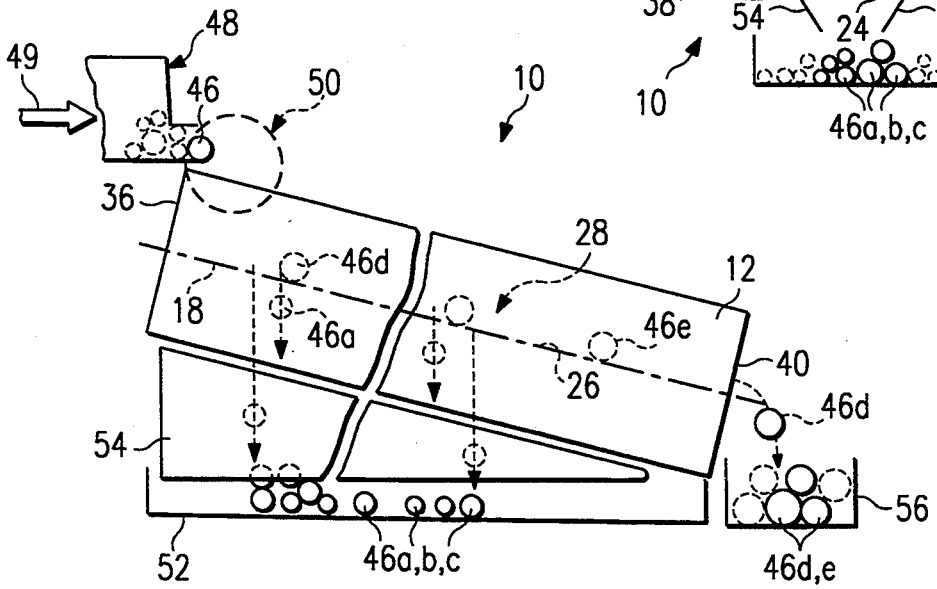
FIG. 1b (PRIOR ART)
Figure 1C:
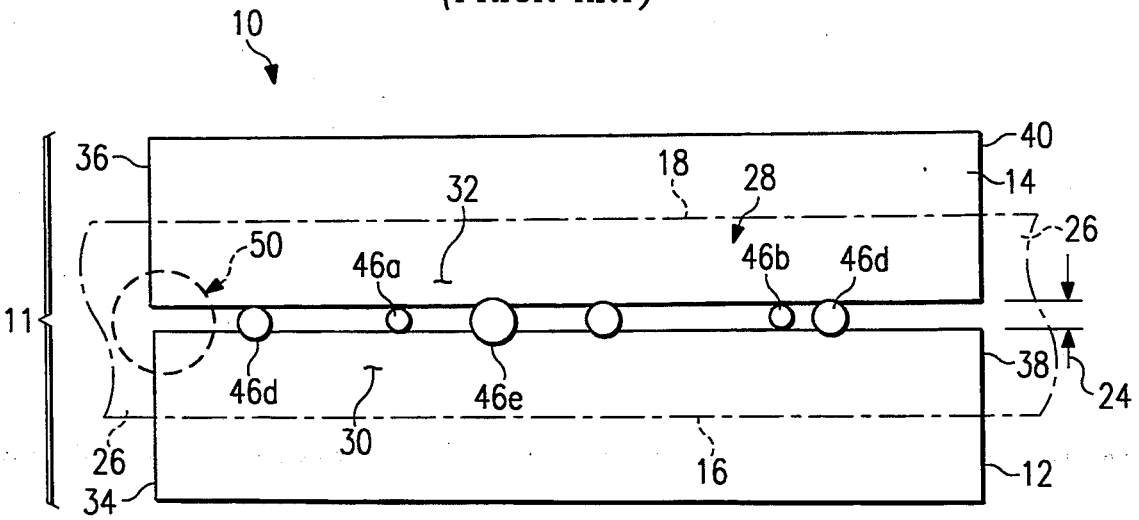
FIG. 1c (PRIOR ART)
Figure 2:
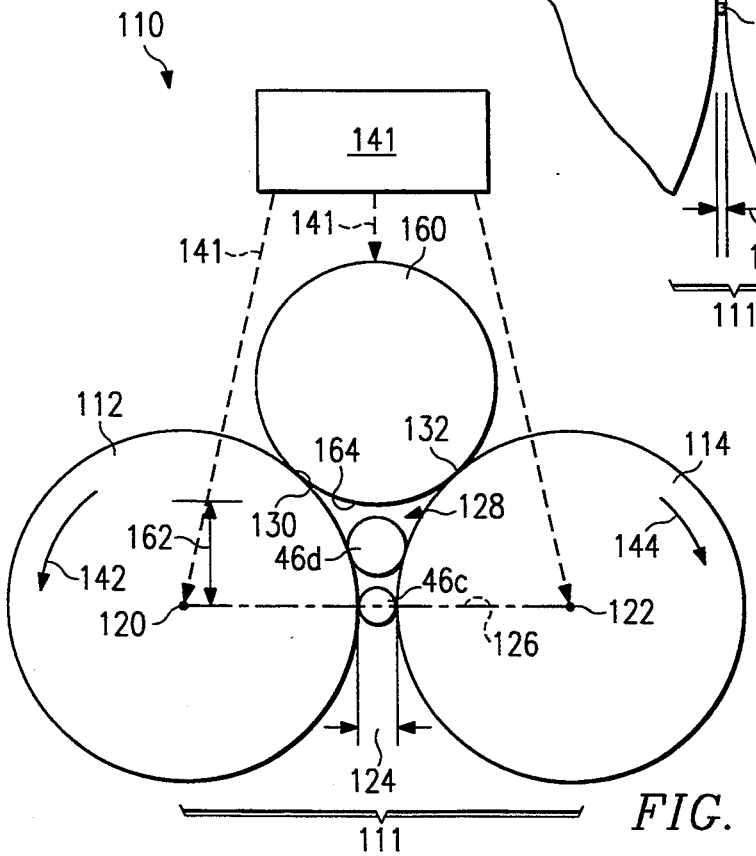
FIG. 2 depicts an improved roll sorter of the type generally shown in FIG. 1 in which there is provided a facility for preventing particles being sorted from exiting the sorter or from being inaccurately sorted.

In FIG. 1(b), the need to periodically remove the particles 46d, etc. is eliminated by tilting the rollers 12 and 14. The smaller particles 50a, etc. pass through the gap 24 into the collector 52, while the larger particles 46d move from left to right under the influence of gravity as aided by the floating action until they fall into a receptacle 56 located adjacent the lower ends 38 and 40. In FIG. 1(b) the input zone 50 is located near the higher roller ends 34 and 36 to ensure that the smaller particles 46a, etc. are not blocked by the larger particles 46d, etc. and will, over time, be presented to the sorting region 28 and the gap 24 as the commingled particles 50 float on the roller surfaces 30 and 32.

Figure 1D:
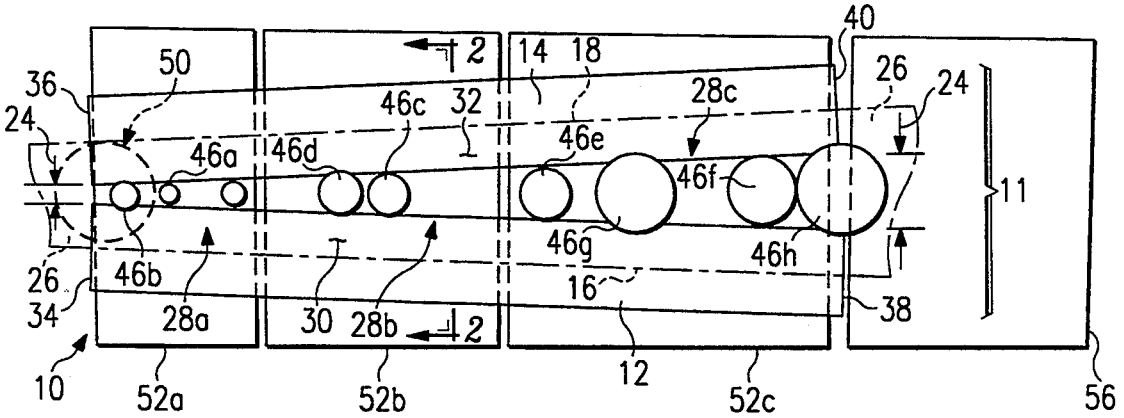
FIG. 1d (PRIOR ART)

In FIG. 1(d), the rollers 12 and 14 diverge. Starting with the closer roller ends 38 and 40, the diverging gap 24 may be viewed as defining a selected number of sorting regions 28a, etc. A range of particles, say 46a and 46b, can pass through the gap 24 somewhere along the region 28a. Larger particles 46c and 46d which cannot pass through the gap 24 in the region 28a, are able to so pass in the region 28b, etc. Largest particles 46h are incapable of passing through the gap 24 anywhere along the length of the sorting region 28. If the rollers in FIG. 1(d) are also tilted (as in FIG. 1(b)), these largest particles 46h ultimately exit the sorting region 28 at the lower roller ends 38 and 40 and fall into the receptacle 56. The smaller particles 50a–50g fall into collectors 52a, 52b, etc. which are coextensive with the regions 28a, 28b, etc. The extent of the regions 28a,28b, etc., and of the collectors 52a are selected as desired to segregate the particles 46 into groups encompassing selected sizes. The input zone 50 is preferably restricted to the closer roller ends 34 and 36 whether or not the sorter 10 of FIG. 1(d) is tilted.

If the gap 24 is uniform, the floating-caused hopping of the particles 46 out of the sorting region 28 is at least a minor problem affecting the throughput of the sorter 10. If the gap 24 diverges, hopping or jumping of the particles 46 can also have a pronounced effect on the accuracy of sorting. Specifically, assume that a particle 46a or 46b is in the sorting region 28a and should pass through the diverging gap 24 within such region 28a. However, due to the particle 46a or 46b hopping and jumping as it floats on the roller surfaces 30 and 32, it leaves the region 28a and enters the region 28b. In this event an undersized particle 46a or 46b will enter the collector 52, which is intended to contain only larger particles 46c and 46d.

In a first test using apparatus as shown in FIG. 1(d), previously sorted silicon particles 46c and 46d having diameters of about 28.5–29.5 mils entered the sorting region 28 thereof. The diameters of the rollers 12,14 were about two inches. The diverging width of one portion 28b of the region 28 was adjusted so that all of the particles 46c, 46d should have fallen into the collector 52b. At a relatively high rotational speed of the rollers 12,14 (approximately 200 rpm) only 65% of the particles 46c,46d fell into the collector 52b; 35% of the particles jumped into the sorting region portion 52c and fell into the incorrect collector 52c. Even when the rotational speed of the rollers 12,14 was decreased by 40% (to 115 rpm), only 85% of the particles 46c,46d were accurately sorted by falling into the collector 52b. The decrease in speed decreased the throughput of the sorter 10, and 15% of the particles 46c,46d were nonetheless inaccurately sorted.

Referring to FIG. 2, an improved sorter 110 according to the present invention is shown. The sorter 110 includes a pair 111 of rollers 112, 114, spaced apart by a gap 124 lying at the bottom of a sorting region 128, all along the lines as described with reference to FIG. 1. Preferably, the apparatus 111 will in many applications take the form of FIG. 1(d) in which the rollers 112,114, the gap 124 and the sorting region 128 diverge and the roller pair 111 is tilted. In this regard, then, FIG. 2 represents, in part, a type of sectional view taken along an arbitrarily chosen line 2—2 in FIG. 1(d).

The sorter 110 also includes a retention rod 160. The retention rod 160 preferably has a generally circular cross-section and is preferably a generally right circular cylinder, although non-circular and/or tapered rods are also contemplated. The retention rod 160 rests on the opposed surfaces 130,132 of the rollers 112,114 above the sorting region 128.

As the rollers 112,114 are counter-rotated, the retention rod 160 floats thereon above the sorting region 128 similar to the way in which the particles 46 float. To prevent excessive hopping or jumping of the retention rod 160—which could result in its temporary, or permanent, departure from its position above the sorting region 128, and could deleteriously affect the surface of the rollers 112,114—its surface finish and is mass or weight are judiciously selected.

The diameter of the retention rod 160—or the diameter thereof along various portions of the sorting region 128—is chosen so that (a) the sorting rod 160 bounds the sorting region 128 to prevent or limit particles 46 from jumping or hopping in such a way as to affect the accuracy of sorting, but(b) permits a sufficient number of the particles 46, ranging in size from the smallest to the largest thereof, to enter the applicable portion of the sorting region 128 so that the throughput of the sorter 110 is not reduced. Stated differently, the diameter of the retention rod 160 is chosen so that the volume of the sorting region 128 is sufficiently large to permit optimum throughput, while the height 162 of the sorting region 128 between the plane 126 and the undersurface 164 of the rod 160 is sufficiently small to prevent jumping or hopping particles 46 from compromising the accuracy of the sorter 110. FIG. 2 schematically illustrates that, as a minimum, the height 162 must be such that the sorting region 128 is able to simultaneously accommodate at least several particles 46.

Those skilled in the art will appreciate that, given rollers 112,114 of predetermined diameters, a gap 124 of a predetermined width and particles 46 having sizes within a predetermined range, the diameter of the retention rod 160 (or diameters, if the rod 160 is tapered) can be selected so that the dual ends of optimum throughput and maximum suppression of hopping and jumping of the particles 46 are easily achieved. The extent of the rod 160 relative to the rollers 11 2, 114 may be selected to be coextensive with the rollers 112,114 or limited to portions of the sorting region 128 where jumping or hopping particles 46 are troublesome. Regardless of the extent of the rod 160, facilities 141 which perform the functions of the facilities 41 of FIG. 1 may be provided for additionally maintaining the retention rod 160 in a selected location relative to the rollers 112,114.

The retention rod 160 will most easily achieve its optimum effect if the range of sizes of the particles 46 sorted by the sorter 110 is rather small or narrow. As the size range of the particles 46 increases—a broad range is shown in the exaggerated depiction of FIG. 2—the height 162 must increase so as to not degrade the throughput of the sorter 110. Increasing height 162 increases the likelihood that particles 46 will be able to hop or jump, thus potentially degrading sorting accuracy. A narrow range of sizes of the particles 46 permits maximizing throughput and accuracy, without compromising either.

In a second test, the sorter 110 included a retention rod 160 as described above, but was otherwise similar to the sorter 10 used to conduct the first test. The rod 160 was a substantially smooth welding rod, having a diameter of 1/16th inches. With the rollers 112,114 rotated at the higher speed and the rod 160 in place, 95% of the particles **46*c*,46*d* fell into the proper collector 152*b*. When the speed was decreased 40%, the use of the retention rod 160 resulted in 100% of the particles 46*c*,46*d* falling into the proper collector 152*b***.

FIG. 3 is similar to FIG. 2, except that FIG. 3 more accurately, but not exactly or to scale, depicts the relationships of the diameters of the rollers 112,114, the retention rod 160, and the smallest (25 mil) and largest (45 mil) particles 46. Specifically, in FIG. 3, particles **46*x*,46*y* are shown as having diameters which are in the approximate ratio of 1.8:1 (the actual ratio is 45 mil:25 mil). FIG. 3 depicts the ratio of the diameters of the rollers 112,114 to the diameter of the smallest particle 36*y* as about 80:1 (the actual ratio is 2 inches:25 mil). The diameter of the retention rod 160 is shown in an approximate ratio of about 3:16 to the diameter of the rollers 112,114 (the actual ratio is about ⅜ inch:2 inch). From FIG. 3 it is apparent that the foregoing diametric relationships result in a height 162 of the undersurface 164 of the retention roller 160 which provides a sufficient volume for the entry of a reasonable number of particles 46 thereinto so that the throughput of the sorter 110 is not degraded. Further, the relative "steepness" of the facing surfaces 130,132 of the rollers 112,114, in conjunction with the "ceiling" provided by the retention rod 160 decrease the likelihood that a particle 46 in the sorting region 128** can sufficiently hop or jump so as to degrade the accuracy of the sorting process.

In FIG. 3, the diametric ratio of the largest particle **46*x* to the smallest particle 46*y* is 1.8:1. These particles 46*x*,46*y*, it should be noted, have diameters at the extremes of the range of particle sizes which are typically suitable for use in solar cells. As discussed earlier, the operation of the present invention is optimized if the diameters of the particles 46** being sorted vary over a narrow range.

What is claimed is:

1. Improved apparatus for sorting particulate material by size, the apparatus being of the type which includes (i) a pair of adjacent, generally coextensive rollers, the rollers having generally circular cross-sections, the facing surfaces of the rollers being separated by a gap which is coplanar with a plane defined by the major axes of the rollers, a sorting region being generally defined and bounded by the plane and the facing surfaces of the rollers above the plane; and (ii) means for counter-rotating the roller surfaces away from the sorting region above the plane and toward the sorting region below the plane; wherein particles in the sorting region float on the counter-rotating rollers, and wherein the improvement comprises:

means for preventing the floating particles from hopping or jumping within or out of the sorting region and thereafter moving along the gap and reentering the sorting region due to the frictional effects on the floating particles of the rotating roller surfaces.

2. Improved apparatus as in claim 1, wherein:

the preventing means comprises a rod which is positioned in the sorting region so as to simultaneously tangentially engage and float on each roller.

3. Improved apparatus as in claim 2, wherein:

the rod has a circular cross-section.

4. Improved apparatus as in claim 3, wherein:

the distance between the lower surface of the rod and the plane is such that hopping and jumping of the particles is obviated without adversely affecting the sorting throughput of the apparatus.

5. Improved apparatus as in claim 3, wherein:

the gap between the rollers is uniform.

6. Improved apparatus as in claim 3, wherein:

the gap between the rollers diverges.

7. Improved apparatus as in claim 6, wherein:

the rollers are tilted.

8. Improved apparatus as in claim 6, wherein:

the rod is a right circular cylinder.

9. Improved apparatus as in claim 3, wherein:

the rod is generally coextensive with the rollers and the sorting region.

10. Improved apparatus as in claim 3, wherein:

the rod is shorter than the rollers and the sorting region.

11. Improved apparatus for sorting particulate material by size, the apparatus being of the type which includes (i) a pair of adjacent, generally coextensive rollers, the rollers having generally circular cross-sections, the facing surfaces of the rollers being separated by a gap which is coplanar with a generally horizontal plane defined by the major axes of the rollers, a sorting region being generally defined and bounded by the plane and the facing surfaces of the rollers above the plane; and (ii) means for counter-rotating the roller surfaces away from the sorting region above the plane and toward the sorting region below the plane; wherein particulate material fed into the sorting region floats on the counter-rotating surfaces of the rollers until particulate material which is equal in size to or smaller in size than the gap passes through the gap, particulate material which is larger in size than the gap being retained and floating on the counter-rotating surfaces of the rollers; wherein the improvement comprises:

means for preventing the floating particles from hopping or jumping within or out of the sorting region and thereafter moving along the gap and reentering the sorting region due to the frictional effects on the floating particles of the rotating roller surfaces.

12. Improved apparatus as in claim 11, wherein:

the rollers and the gap diverge so that floating particles of varying sizes are capable of passing through different portions of the gap, the jumping or hopping, movement along the gap, and the reentry of the particles affects the sorting accuracy of the apparatus by permitting particles to pass through portions of the gap which are larger than required for such passage.

13. Improved apparatus as in claim 12, wherein:

the preventing means comprises a rod positioned in the sorting region so as to simultaneously tangentially engage and float on each roller.

14. Improved apparatus as in claim 13, wherein: the rod has a circular cross-section.

15. Improved apparatus as in claim 13, wherein: the distance between the lower surface of the rod and the plane is such that hopping and jumping of the particles is obviated without adversely affecting the sorting throughput of the apparatus.

16. Improved apparatus for sorting particulate material by size, the apparatus being of the type which includes (i) a pair of adjacent, generally coextensive rollers, the rollers having generally circular cross-sections, the facing surfaces of the rollers being separated by a gap which is coplanar with a plane defined by the major axes of the rollers, a sorting region being generally defined and bounded by the plane and the facing surfaces of the rollers above the plane; and (ii) means for counter-rotating the roller surfaces away from the sorting region above the plane and toward the sorting region below the plane; wherein particles in the sorting region float on the counter-rotating rollers, and wherein the improvement comprises:

means located substantially entirely in the sorting region for preventing the floating particles from hopping or jumping within or out of the sorting region and thereafter moving along the gap and reentering the sorting region due to the frictional effects on the floating particles of the rotating roller surfaces.

* * * * *